US010292428B2

(12) United States Patent
Li et al.

(10) Patent No.: US 10,292,428 B2
(45) Date of Patent: May 21, 2019

(54) ATOMIZER AND ELECTRONIC CIGARETTE HAVING SAME

(71) Applicant: SHENZHEN FIRST UNION TECHNOLOGY CO., LTD., Shenzhen, Guangdong Province (CN)

(72) Inventors: Yonghai Li, Shenzhen (CN); Zhongli Xu, Shenzhen (CN); Xiaoqiang Zhao, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/619,484

(22) Filed: Jun. 10, 2017

(65) Prior Publication Data

US 2017/0273361 A1 Sep. 28, 2017

(30) Foreign Application Priority Data

Jun. 10, 2016 (CN) ..... 2016 2 0551709 U

(51) Int. Cl.

| | |
|---|---|
| ***A24F 13/00*** | (2006.01) |
| ***A24F 47/00*** | (2006.01) |
| ***F22B 1/28*** | (2006.01) |
| ***H05B 3/42*** | (2006.01) |

(52) U.S. Cl.

CPC ..... *A24F 47/008* (2013.01); *F22B 1/284* (2013.01); *H05B 3/42* (2013.01)

(58) Field of Classification Search

CPC ..... A24F 47/00
USPC ..... 131/328, 329
See application file for complete search history.

(56) References Cited

U.S. PATENT DOCUMENTS

2016/0044966 A1* 2/2016 Li ..... A24F 47/008 131/329
2016/0183596 A1* 6/2016 Rado ..... A24F 47/008 392/395

* cited by examiner

*Primary Examiner* — Phuong K Dinh
(74) *Attorney, Agent, or Firm* — Cheng-Ju Chiang

(57) ABSTRACT

An exemplary atomizer includes a housing, a mouthpiece, a liquid chamber arranged in the housing, and an atomizing component arranged in the liquid chamber. The liquid chamber is configured for storing tobacco liquid, and defines an air passage. An end of the air passage is connected with the mouthpiece. The atomizing component is configured for atomizing the tobacco liquid to form aerosol. The air passage allows the aerosol to pass through. An opposite end of the air passage is in communication with the atomizing component. The liquid chamber defines a liquid outlet at a bottom part. The liquid outlet is in communication with the atomizing component, so that the tobacco liquid in the liquid chamber can flow to the atomizing component via the liquid outlet.

11 Claims, 6 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

An electronic cigarette includes a liquid chamber for containing tobacco liquid and an atomizing head for atomizing the tobacco liquid. The atomizing head includes a liquid conducting element, and a heating element in contact with the liquid conducting element.

In a typical electronic cigarette, the atomizing head defines a liquid inlet at the top. The tobacco liquid in the liquid chamber flows into the liquid conducting element for atomization via the liquid inlet. However, the tobacco liquid below the liquid inlet cannot flow into the atomizing component. This part of tobacco liquid may remain for a long time, and deteriorate, thus rendering user unsatisfactory.

What are needed, therefore, are an atomizer and an electronic cigarette using same, which can overcome the above shortcomings.

SUMMARY

An exemplary atomizer includes a housing, a mouthpiece, a liquid chamber arranged in the housing, and an atomizing component arranged in the liquid chamber. The liquid chamber is configured for storing tobacco liquid, and defines an air passage. An end of the air passage is connected with the mouthpiece. The atomizing component is configured for atomizing the tobacco liquid to form aerosol. The air passage allows the aerosol to pass through. An opposite end of the air passage is in communication with the atomizing component. The liquid chamber defines a liquid outlet at a bottom part. The liquid outlet is in communication with the atomizing component, so that the tobacco liquid in the liquid chamber can flow to the atomizing component via the liquid outlet.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
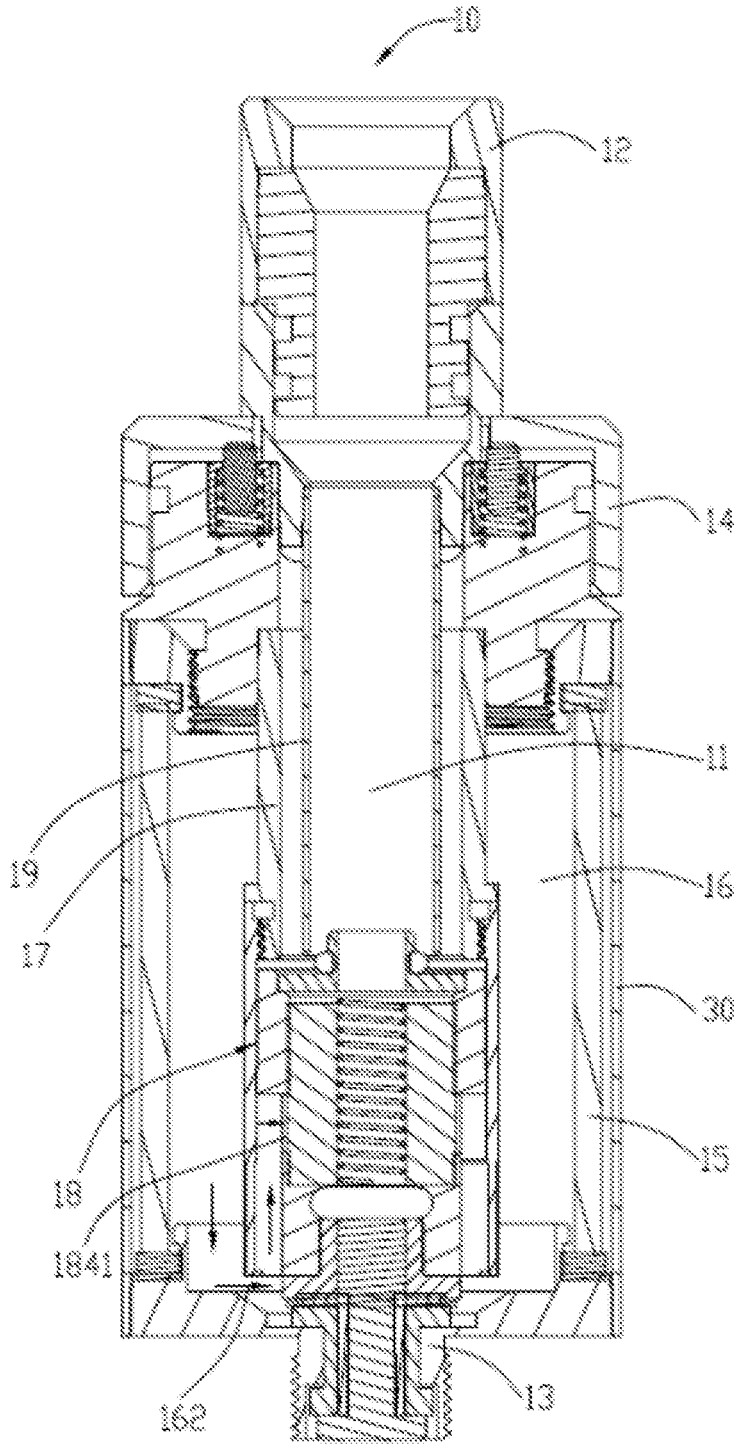
FIG. 1 is a cross-sectional view of an atomizer according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIGS. 1-5, an atomizer 10 is shown. The atomizer 10 includes a housing 30, a mouthpiece 12, a first connecting element 14, a liquid chamber 16, and an atomizing component 18. The liquid chamber 16 is arranged in the housing 30, and is configured (i.e., structured and arranged) for storing tobacco liquid. A top part of the liquid chamber 16 is connected to the mouthpiece 12 via the first connecting element 14. The liquid chamber 16 defines an air passage 11 allowing aerosol to pass through. One end of the air passage 11 is connected to the mouthpiece 12; the other end of the air passage 11 is connected to the atomizing component 18. The first connecting element 14 defines an air inlet 142, and the air inlet 142 is in communication with the air passage 11. The liquid chamber 16 defines a liquid outlet 162 at a bottom part. The liquid outlet 162 is in communication with the atomizing component 18, so that the tobacco liquid can flow out via the liquid outlet 162, and flow to the atomizing component 18. The atomizing component 18 is configured for atomizing the tobacco liquid to form aerosol.

The atomizing component 18 includes an atomizing cover 182, a holder 184, a liquid conducting element 186, and a heating element 188. The holder 184 is received in the atomizing cover 182. The liquid conducting element 186 is nested in the holder 184. The heating element 188 is formed on an internal wall of the liquid conducting element 186. The holder 184 is substantially cylindrical. The holder 184 includes a sidewall defining a liquid inlet 1841. The sidewall further defines a recess 1844 in an external surface of the sidewall. The recess 1844 extends along an axial direction of the holder 184. The liquid inlet 1841 communicates with the liquid inlet 162 via the recess 1844, such that the tobacco liquid in the liquid chamber 16 can permeate the liquid conducting element 186. A flowing direction of the tobacco liquid is shown in arrows in FIG. 1. The liquid conducting element 186 is hollow, and defines an atomizing chamber 183 inside. In the present embodiment, the liquid conducting element 186 is substantially cylindrical, and the heating element 188 is a heating wire in a spiral form. The heating element 188 is coaxial with the liquid conducting element 186. It is noteworthy that the heating element 188 may be a heating piece.

Figure 6:
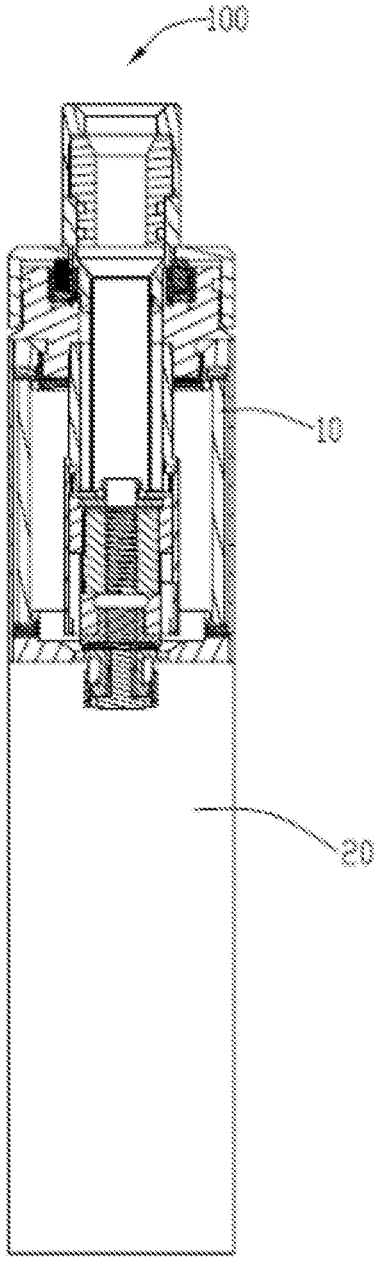
FIG. 6 is a cross-sectional view of an electronic cigarette according to a second embodiment.

The atomizer 10 further includes a second connecting element 13, which forms a bottom part of the liquid chamber 16. The second connecting element 13 is configured for connecting with a power supply 20 (as seen in FIG. 6), thus achieving a mechanical and electrical connection. A gap is defined between an end of the atomizing cover 182 away from the mouthpiece 12 and a top surface of the second connecting element 13. The gap serves as the above liquid outlet 162.

Further, the air inlet 142 is defined in a sidewall of the first connecting element 14.

Figure 2:
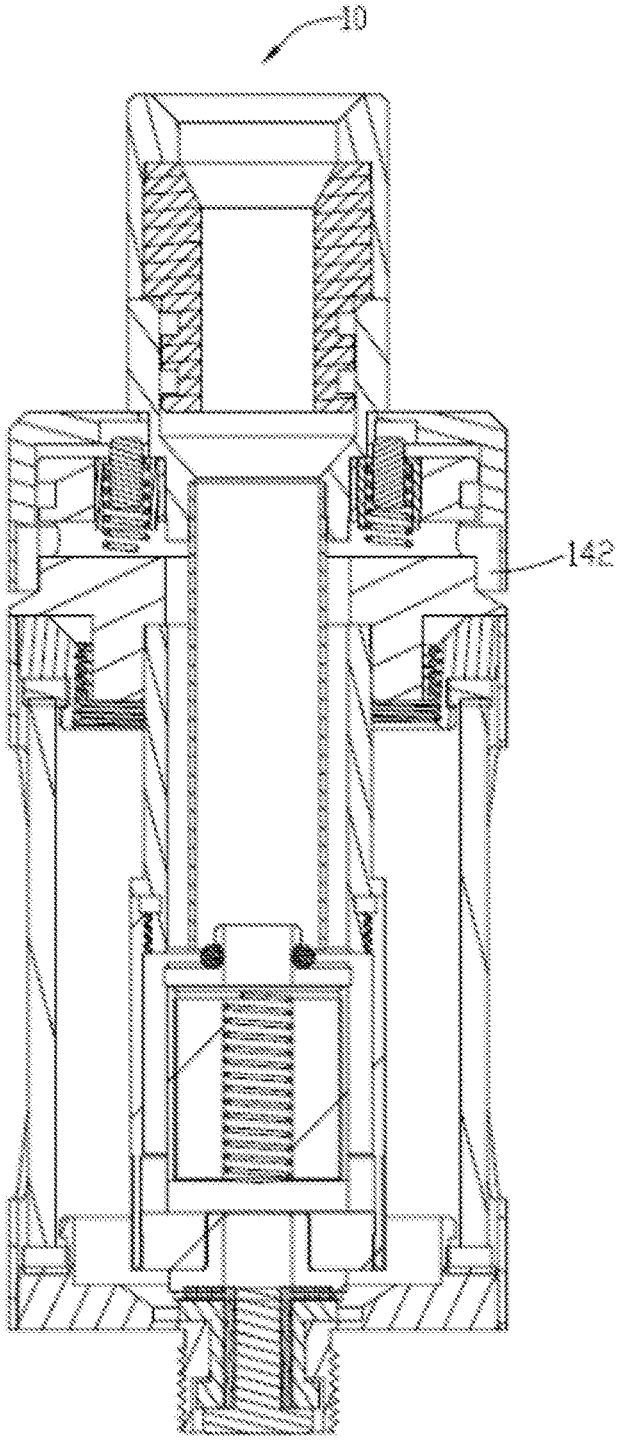
FIG. 2 is another cross-sectional view of the atomizer of FIG. 1.
Figure 3:
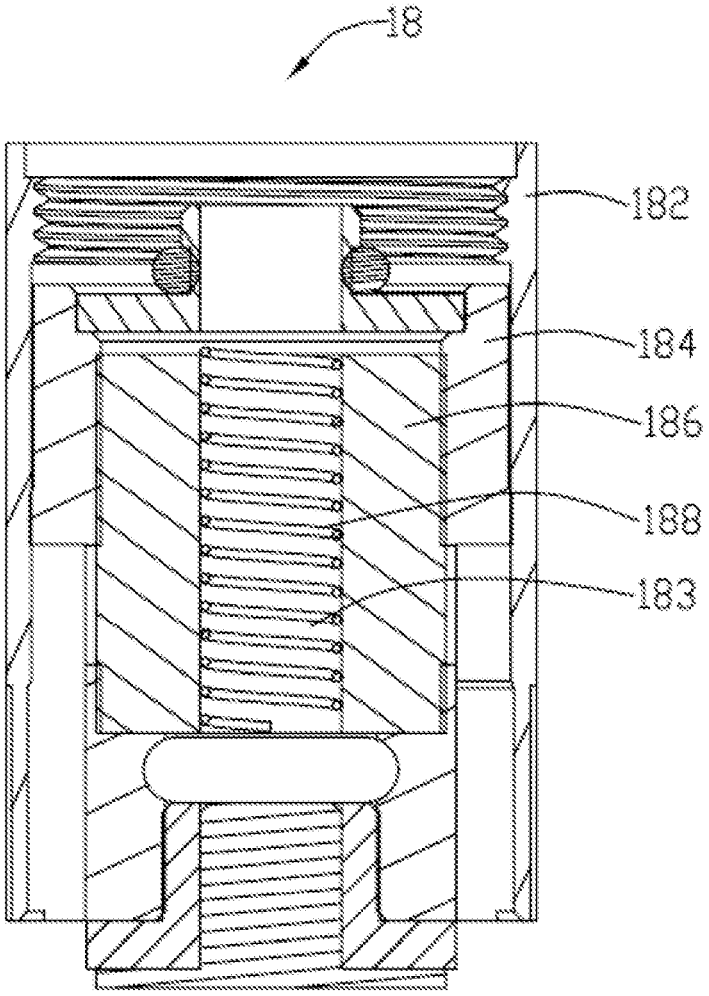
FIG. 3 is a cross-sectional view of an atomizing component of FIG. 1.
Figure 4:
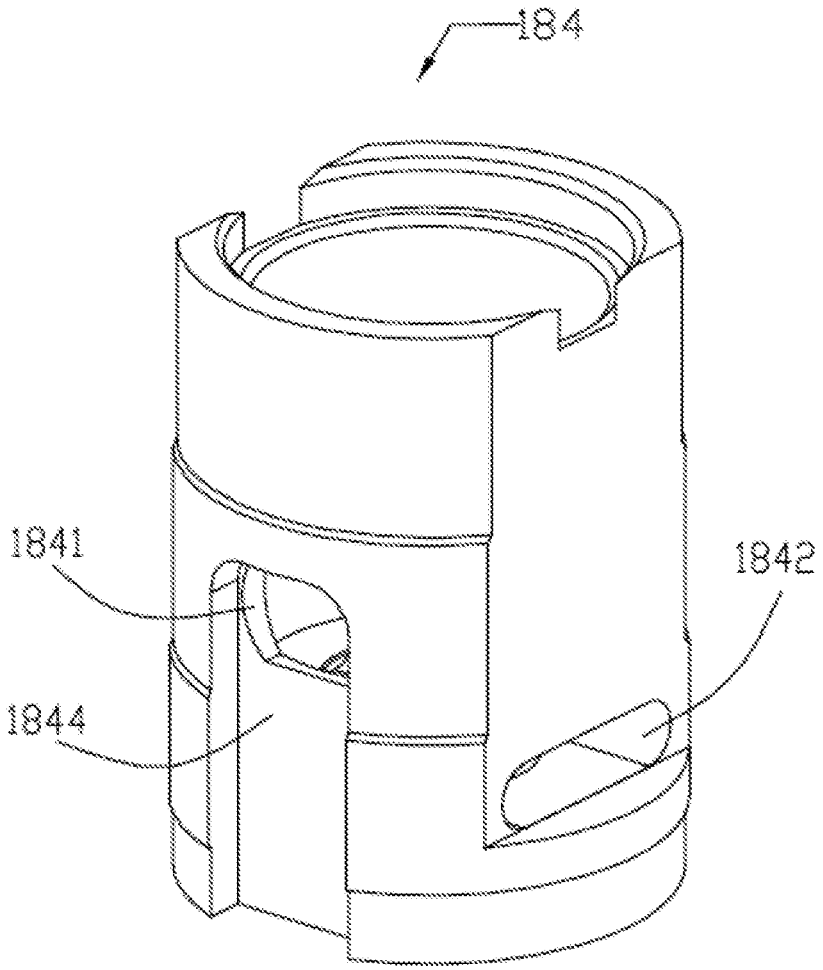
FIG. 4 is a perspective view of a holder of the atomizer of FIG. 1.
Figure 5:
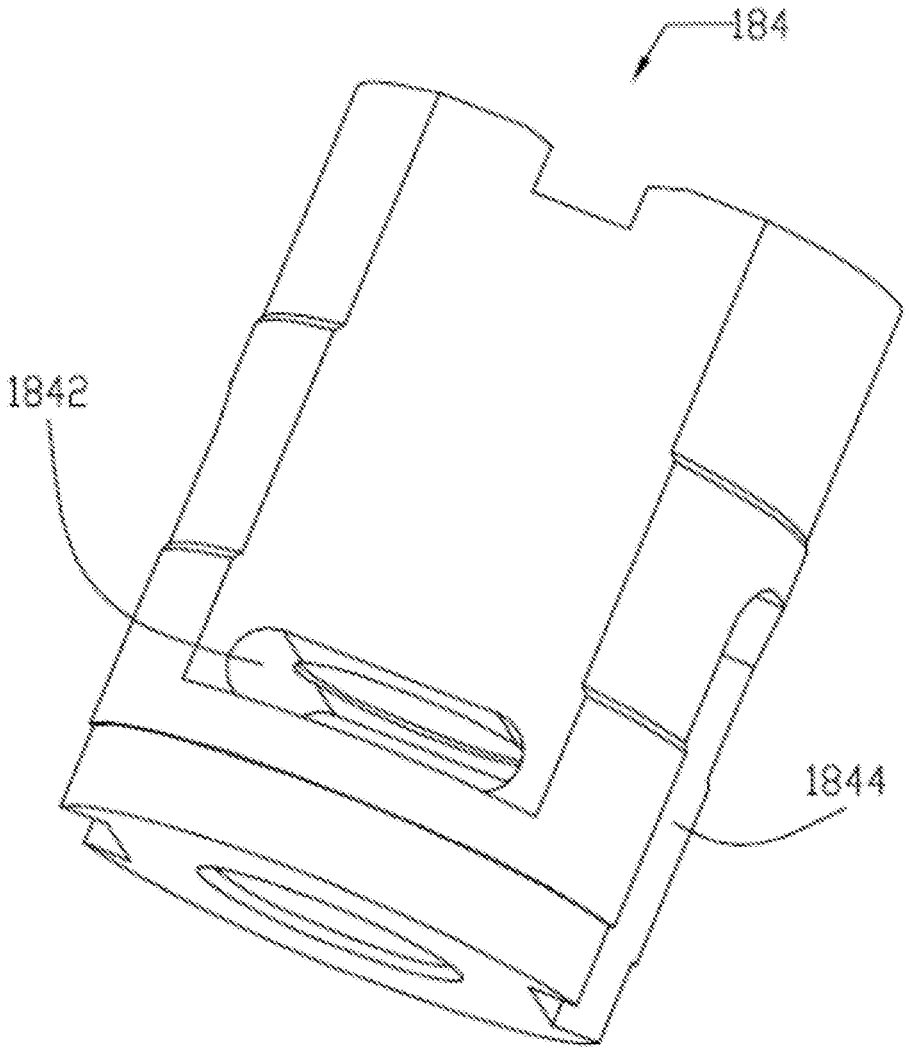
FIG. 5 is another perspective view of the holder of FIG. 4.

Even further, referring to FIGS. 2 and 4, the holder 184 defines an air hole 1842 in a sidewall. The air hole 1842 is in communication with the air inlet 142, and the atomizing chamber 183. The air inlet 142 is in communication with the air passage 11 via the air hole 1842, and the atomizing chamber 183 sequentially. The liquid conducting element 186 and the heating element 188 are arranged between the air hole 1842 and the air passage 11.

Still furthermore, the atomizer 10 further includes an outer tube 15 and an inner tube 17 both arranged in the housing 30. The liquid chamber 16 is cooperatively defined between the outer tube 15, the inner tube 17, the atomizing cover 182, and the second connecting element 13.

Yet further, the atomizer 10 further includes an air pipe 19 arranged in the inner tube 17. An internal space of the air pipe 19 forms part of the air passage 11. One end of the air pipe 19 is connected to the mouthpiece 12; the other end of the air pipe 19 is in communication with the liquid conducting element 186.

Referring to FIG. 6, an electronic cigarette 100 is shown. The electronic cigarette 100 includes the atomizer 10 and a power supply 20. The power supply 20 is configured for supplying the atomizer 10 power.

In the present disclosure, the liquid outlet 162 is defined at the bottom part of the liquid chamber 16, so that most of the tobacco liquid can permeate the atomizing component 18 via the liquid outlet 162. Accordingly, little tobacco liquid remains in use. Therefore, user experience of the electronic cigarette 100 is satisfactory.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a housing;

a mouthpiece;

a liquid chamber arranged in the housing, the liquid chamber being configured for storing tobacco liquid, the liquid chamber defining an air passage, an end of the air passage being connected with the mouthpiece; and an atomizing component arranged and completely accommodated in the liquid chamber next to the air passage, the atomizing component being configured for atomizing the tobacco liquid to form aerosol, the air passage allowing the aerosol to pass through, an opposite end of the air passage being in communication with the atomizing component;

wherein the liquid chamber defines a liquid outlet at a bottom part, the liquid outlet is in communication with an end of the atomizing component located away from the air passage, so that the tobacco liquid in the liquid chamber can flow to the end of the atomizing component via the liquid outlet.

2. The atomizer according to claim 1, wherein the atomizing component comprises a holder, a liquid conducting element nested in the holder, and a heating element arranged in the liquid conducting element, the liquid conducting element is hollow and defines an atomizing chamber, the holder comprises a sidewall, the sidewall defines a liquid inlet, and the liquid inlet is in communication with the liquid outlet, so that the tobacco liquid flowed into the atomizing component can permeate the liquid conducting element.

3. The atomizer according to claim 2, further comprising a first connecting element, wherein the housing is connected to the mouthpiece via the first connecting element, the first connecting element defines an air inlet, and the air inlet is in communication with the atomizing chamber in the liquid conducting element.

4. The atomizer according to claim 3, wherein the sidewall of the holder further defines an air hole, the air hole is in communication with the air inlet; the opposite end of the air passage is in communication with the atomizing chamber, and the air inlet is in communication with the air passage via the air hole, and the atomizing chamber sequentially.

5. The atomizer according to claim 4, wherein the liquid conducting element and the heating element are arranged between the air hole and the air passage.

6. The atomizer according to claim 2, wherein the sidewall further defines a recess in an external surface of the sidewall, the recess extends along an axial direction of the holder, and the liquid inlet is in communication with the liquid outlet via the recess.

7. The atomizer according to claim 6, wherein the atomizing component further comprises an atomizing cover nesting the atomizing cover.

8. The atomizer according to claim 7, further comprising an outer tube arranged in the housing, an inner tube arranged in the outer tube, and a second connecting element, wherein the second connecting element is configured for connecting with an external power supply, the liquid chamber is cooperatively defined by the outer tube, the inner tube, the atomizing cover, and the second connecting element, and the liquid outlet is defined by an end of the atomizing cover away from the mouthpiece, and the second connecting element.

9. The atomizer according to claim 2, wherein the heating element comprises a heating wire in a spiral form, and the heating wire is coaxially arranged on an internal surface of the liquid conducting element.

10. An electronic cigarette, comprising:

an atomizer according to claim 1; and a power supply configured for feeding the atomizer power.

11. An atomizer, comprising:

a housing;

a mouthpiece;

a liquid chamber arranged in the housing, the liquid chamber being configured for storing tobacco liquid, the liquid chamber defining an air passage, an end of the air passage being connected with the mouthpiece; and an atomizing component arranged in the liquid chamber, the atomizing component being configured for atomizing the tobacco liquid to form aerosol, the air passage allowing the aerosol to pass through, an opposite end of the air passage being in communication with the atomizing component;

wherein the liquid chamber defines a liquid outlet at a bottom part, the liquid outlet is in communication with the atomizing component, so that the tobacco liquid in the liquid chamber can flow to the atomizing component via the liquid outlet; and wherein the atomizing component comprises a holder, a liquid conducting element nested in the holder, and a heating element arranged in the liquid conducting element, the liquid conducting element is hollow and defines an atomizing chamber, the holder comprises a sidewall, the sidewall defines a liquid inlet, and the liquid inlet is in communication with the liquid outlet, so that the tobacco liquid flowed into the atomizing component can permeate the liquid conducting element.

* * * * *